US007238108B2

(12) United States Patent
Webb

(10) Patent No.: US 7,238,108 B2
(45) **Date of Patent: *Jul. 3, 2007**

(54) CASINO GAME WITH MULTIPLE PLAYING MODES AND WAGERING OPTIONS

(75) Inventor: Derek J. Webb, Derby (GB)

(73) Assignee: Prime Table Games LLC, Las Vegas, NV (US)

( * ) Notice: Subject to any disclaimer, the term of this patent is extended or adjusted under 35 U.S.C. 154(b) by 1008 days.

This patent is subject to a terminal disclaimer.

(21) Appl. No.: 10/261,784

(22) Filed: Oct. 2, 2002

(65) Prior Publication Data

US 2003/0027614 A1 Feb. 6, 2003

Related U.S. Application Data

(63) Continuation-in-part of application No. 09/589,202, filed on Jun. 8, 2000, now Pat. No. 6,503,145.

(51) Int. Cl.
*G06F 17/00* (2006.01)

(52) U.S. Cl. ..... 463/13; 463/12; 273/292

(58) Field of Classification Search ..... 463/13
See application file for complete search history.

(56) References Cited

U.S. PATENT DOCUMENTS

| | | | | |
|---|---|---|---|---|
| 5,265,882 | A | 11/1993 | Malek | |
| 5,328,189 | A | 7/1994 | Malek | |
| 5,395,120 | A | 3/1995 | Malek | |
| 5,407,199 | A | 4/1995 | Gumina | |
| 5,494,296 | A | 2/1996 | Grassa | |
| 5,531,448 | A | 7/1996 | Moody | |
| 5,639,092 | A * | 6/1997 | Macaisa | 273/292 |
| 5,653,444 | A | 8/1997 | Dahl | |
| 5,678,821 | A * | 10/1997 | Hedman | 273/292 |
| 5,685,774 | A * | 11/1997 | Webb | 463/13 |
| 5,839,732 | A | 11/1998 | Guidi | |
| 5,868,392 | A * | 2/1999 | Kraft | 273/292 |
| 5,868,618 | A | 2/1999 | Netley et al. | |
| 5,897,436 | A | 4/1999 | Singer et al. | |
| 5,901,958 | A * | 5/1999 | Andrews | 273/292 |
| 5,975,529 | A | 11/1999 | de Keller | |
| 5,988,643 | A | 11/1999 | Awada | |
| 6,019,374 | A | 2/2000 | Breeding | |
| 6,056,641 | A * | 5/2000 | Webb | 463/13 |
| 6,070,873 | A | 6/2000 | Perkins | |
| 6,113,102 | A | 9/2000 | Marks et al. | |
| 6,131,908 | A | 10/2000 | Palmer | |
| 6,158,741 | A | 12/2000 | Koelling | |
| 6,182,969 | B1 | 2/2001 | Green | |
| 6,206,375 | B1 | 3/2001 | Wichinsky | |
| 6,227,969 | B1 | 5/2001 | Yoseloff | |
| 6,334,614 | B1 | 1/2002 | Breeding | |
| 6,416,407 | B1 * | 7/2002 | Carrico et al. | 463/13 |

* cited by examiner

*Primary Examiner*—Robert E. Pezzuto
*Assistant Examiner*—Tramar Harper
(74) *Attorney, Agent, or Firm*—Nixon & Vanderhye P.C.

(57) ABSTRACT

A casino game incorporates at least a first compulsory playing mode and one or more optional playing modes without a house advantage. Preferably, the first playing mode is a three-, five- or seven-card poker game against a payout scale based on the respective hand poker rank or against both a payout scale and the dealer. Optional modes without a house advantage include head-to-head poker games against the dealer only and poker games against other players. Side wager options are also available for high hands, thereby increasing player interest by providing a chance for a high payout.

10 Claims, 2 Drawing Sheets

CASINO GAME WITH MULTIPLE PLAYING MODES AND WAGERING OPTIONS

CROSS-REFERENCES TO RELATED APPLICATIONS

This is a continuation-in-part of U.S. patent application Ser. No. 09/589,202, filed Jun. 8, 2000, now U.S. Pat. No. 6,503,145, the entire content of which is hereby incorporated by reference in this application.

STATEMENT REGARDING FEDERALLY SPONSORED RESEARCH OR DEVELOPMENT (NOT APPLICABLE)

BACKGROUND OF THE INVENTION

The present invention relates to a casino game incorporating multiple playing modes and multiple wagering options and, more particularly, to a casino poker game that includes modes of play with no casino advantage.

Casino operators are continuously searching for ways to make casino table games more attractive and player friendly. New poker derivatives such as Caribbean Stud, Let-it-Ride, Pai Gow Poker, and Three Card Poker have made a significant contribution; however, many traditional players still regard these games as having too high a house advantage. Therefore, there would be a significant market for a poker derivative game where the house advantage was less apparent. Ideally, a beneficial innovation could include the implementation of a game incorporating bets with no house advantage.

With respect to types of poker, conventional established terms are draw and stud. These terms have become out-of-date as community card games and showdown games are established. Community card games such as Hold'em and Omaha could be regarded as combining aspects of both draw and stud, whereas showdown could be dealt as either a draw, stud or community card version.

Showdown is a version where equal bets by each player are made, and each player receives the appropriate poker hand for the variation played. The hands are shown and the best hand wins. Therefore, there is no skill at basic showdown. This version has been played as one-table satellite events for tournaments, whereby the total pool or pot of equal player bets or entry fees is sufficient to enable the winner to enter the relevant poker tournament.

There are of course a variety of forms of poker such as three-card, five-card and seven-card. These varieties could be played in each of the types described, being draw, stud, community card or showdown. Also, there are different play methodologies such as player hand against player hand, player hand against house/dealer hand and player hand against payoff scale.

It would be desirable to incorporate all three play methodologies in as simple a poker game as possible and allow certain of these methodologies to be played without a house advantage inherent in those methodologies. The simplest type of poker game is showdown. The invention should be applicable to any form of poker but should most easily be applied to a standard three-card hand, a standard five-card hand and a standard seven-card hand, wherein the best five-card hand of the seven cards is utilized.

If the house advantage is applied to the payoff scale wager only, and the player against player and player against dealer wagers are dependent upon the payoff scale wager, then both of the dependent wager modes could be operated without any house advantage.

BRIEF SUMMARY OF THE INVENTION

The game according to the invention, so-called Showdown Poker, is preferably played in a casino environment using a house dealer. The table is preferably a blackjack style size with a special dedicated cloth layout. One or more decks of standard fifty-two card decks are used with regular established poker rankings attributed to card combinations. Up to seven players and a dealer can be accommodated, with each player having a separate and distinct betting area.

Each player betting area has three or four individual betting areas, one for each mode of play, respectively. A compulsory mode of play is the mode against a payoff scale, which may also be against both the payoff scale and the dealer. Optional modes of play are a mode of player hand against player hand and player hand against dealer hand only. As the optional modes are dependent upon play in the compulsory modes, there may be a numerical relationship between the wagers, which would preferably be an equal amount. Alternatively, if both the wager against the pay scale and the wager against the dealer and pay scale were placed, the optional mode wagers can include an amount up to the sum of those two wagers. The game could alternatively be operated either where one optional bet is compulsory or both optional bets are compulsory. Optional bets may be for any amount from the table minimum to, for example, the amount of the compulsory bet, or sum of the compulsory bets, and the two optional bets may be of similar or different amounts.

After placing bets, dealing hands and showing cards, all bets are resolved. The method of resolution of player hand against dealer hand is to compare the two hands, with the best hand according to the rules winning. If the house hand winds the player loses, but if the player hand wins, the player wins 1 to 1. This mode of play has no house advantage.

The method of resolution of player hand against player hand could include the dealer hand as a participating hand, thereby allowing resolution of this mode even when there is only one player and also where multiple players have placed different wager amounts. The player hand with the lowest wager in this mode is compared with all other player hands. The player with the best hand receives the amount of that wager from each player, including the dealer if the dealer is functioning as a player in this mode. That lowest wager hand is then ignored, and the player hand with the lowest remaining wager is compared and resolved using the same method. This process is repeated until all bets are resolved or until only one player remains. If the dealer functions as a player, then the bet is resolved by the same method as the player against dealer mode, whereas if the dealer does not function as a player, the surplus wager is merely returned to the player. This mode of play also has no house advantage.

The method of resolution of the payoff scale bets involves taking a losing hand wager and paying appropriate winning hand wagers according to a variable payout. With the independent single wager against both the pay scale and the dealer, the payoff scale includes a comparison with the dealer hand, whereby with an inferior hand to the dealer hand, the player wager either loses or pushes. The desired house advantage is embodied in the payoff scale, and as the payoff wager is compulsory, an overall house advantage is effected.

BRIEF DESCRIPTION OF THE DRAWINGS

These and other aspects and advantages of the present invention will be described in detail with reference to the accompanying drawings, in which.

DETAILED DESCRIPTION OF THE INVENTION

Figure 1:
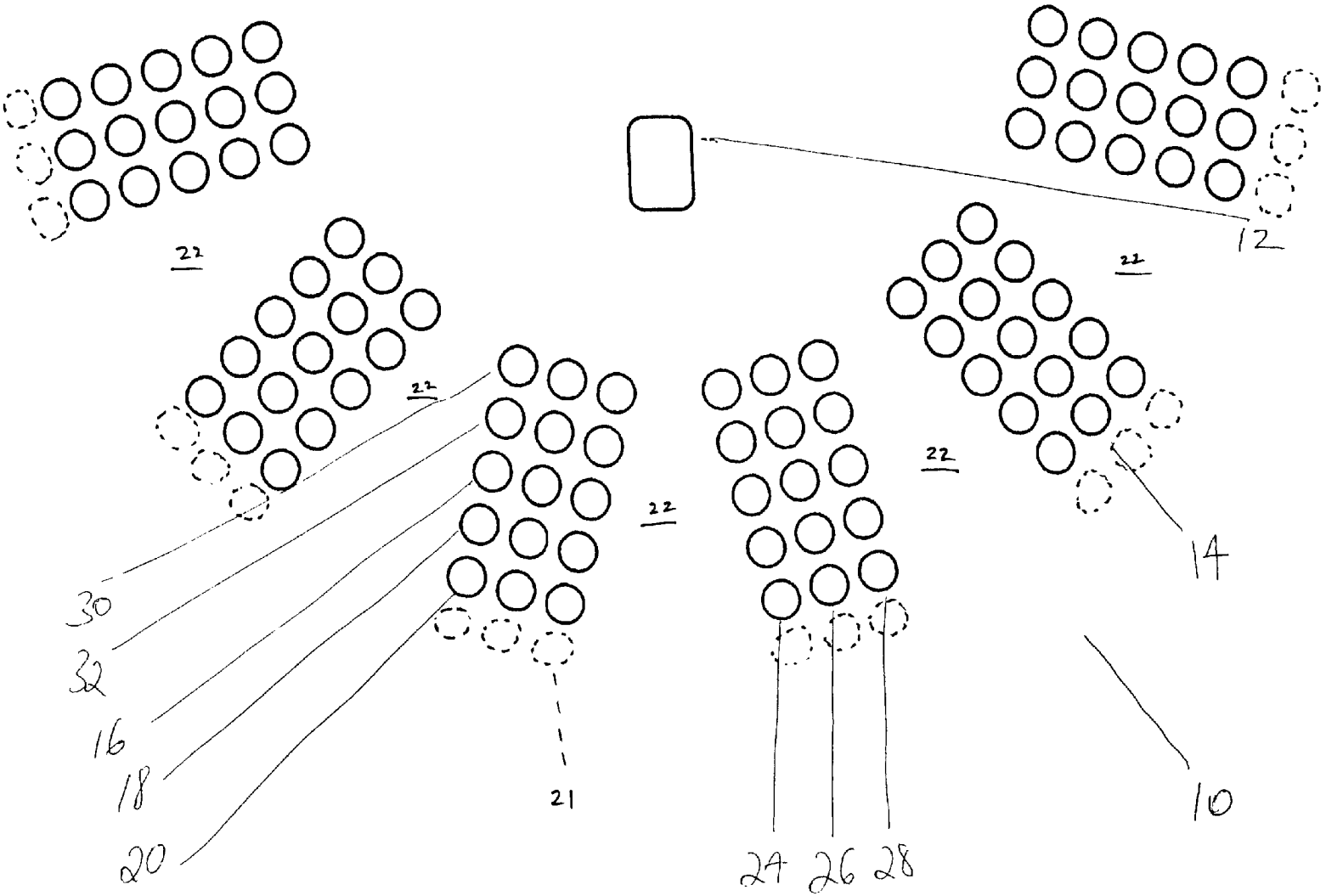
FIG. 1 is a plan view of the table layout according to the present invention.

FIG. 1 is a plan view of an exemplary layout 10 for the game according to the present invention. The layout 10 includes a dealer area 12 and a plurality of betting areas 14. Preferably, up to seven players can participate in the game at a time.

Each player betting area 14 includes three or four wager options for three or four different playing modes plus two side bet options for each version, totaling fifteen or eighteen player wager options. The desired mode of play and selected wagering option is indicated by the player's wager placement. The player betting areas 14 each include a pay scale wager area 16, an "against dealer and pay scale" wager area 18, and an "against dealer" wager area 20. In a second operating mode, shown in dashed line in FIG. 1, a fourth wager area 21 is for an "against players" wager area, which possibly also includes the dealer. Rules and payoffs are shown, for example, between the player betting areas 14 at areas 22.

Each of the playing modes can preferably be played as a three-card game, a five-card game or a seven-card game. The player betting areas 14 thus also include for each playing mode a three-card wager area 24, a five-card wager area 26, and a seven-card wager area 28. Two side bet wager areas 30, 32 are also provided for each card multiple option. Of course, the game may be played with fewer or greater options, and the invention is not meant to be limited to the illustrated example.

Preferably, a single standard fifty-two card deck of playing cards is used using conventional poker combinations. In alternative arrangements, multi-deck playing modes could be contemplated, and other means for determining hand ranks could be used, such as numerical totals with a blackjack or baccarat count system. Still other alternatives could utilize dice with poker values or numerical values applying.

Players place wagers according to game rules and preferably with a compulsory wager at payout mode either wager area 16 or wager area 18 for any of the card number options (24, 26, 28). The card number options at 24, 26 and 28 may be fixed according to playing modes (e.g., three-card wager at 16 only, five-card wager at 18only, seven-card wager at 20 only) or by player choice or mixed variations. Wagers for the "against dealer" mode at 20 and the "against player" mode at 21 are optional and in a preferred embodiment, may be placed only for card number modes matching the card number mode of the payoff mode wager at 16. Moreover, it is preferable to limit the optional wagers at 20 and 21 to a multiple of the alternative compulsory wagers at 16, 18,such as a multiple of 1 (i.e., equal amounts). If wagers are placed at both wager area 16 and wager area 18, the optional wagers may be limited to a sum of the wagers at 16, 18 or some other dependent relationship.

Three cards are dealt to each player area 14 and the dealer area 12. Subsequently, three-card wagers at 24 with wagers at 16/24 are paid according to a payout scale by comparing the player three-card hands with hand ranks set forth on the payout scale; three-card wagers at 18/24 are paid according to a comparison of the player three-card hand rank with the dealer three-card hand rank and by comparing the player three-card hand with hand ranks set forth on a modified payout scale (typically with higher payouts); three-card wagers at 20/24 are either taken or paid 1 to 1 based on a comparison of the player three-card hand rank with the dealer three-card hand rank; and winning hands at wager area 21/24, if included, are paid by each player for an amount equal to the amount wagered by the player(s) with the winning hands. In one embodiment, the dealer may also be considered a player for wagers at area 21 so that this mode of play can still be used in the event of a single player game. For wagers at wager area 18, with a player hand rank exceeding a minimum rank for payout based on the pay scale but an inferior hand to the dealer hand, the player wager either loses or pushes. In this manner, the payout scale for wagers at wager area 18 can be higher than for wagers at wager area 16.

In the event of a tied hand for wagers at 20/24, the wagers are pushed, and in case of tied hands for wagers at 21/24, preferably, tied hands split winnings. Odd chips are distributed according to an accepted formula, such as either first hand to the left of a rotating deal assignation, or suit order ranking of the highest card. For example, the scale of clubs, diamonds, hearts, spades could apply whereby if the highest card in each tied hand was an Ace, then the Ace of clubs would be regarded as the winner of the odd chips; and if the Ace of clubs was not in the hands, then the Ace of diamonds would be regarded as the winner, and so on.

Each player and the dealer then receive two additional cards, totaling five cards. Wagers at 16/26, 18/26, 20/26, and 21/26 (if included) are then resolved in the same manner as described above. Finally, in this embodiment, each player and the dealer then receive two additional cards, making a seven-card hand from each of which a five-card hand is selected, and wagers at 16/28, 18/28, 20/28 and 21/28 (if included) are resolved. Alternative versions of the subject game could incorporate only one or two of the required number of cards to constitute a hand. Further, yet another alternative could incorporate only the compulsory mode, or the compulsory mode and only one of the optional modes. One or both of the wagers at 20 and 21 may also be made compulsory.

With continued reference to FIG. 1, the game according to the invention may also include one or more side wagers, for example at areas 30 and 32, respectively. As shown, each side bet 30, 32 is applicable to each card number mode of play (24, 26, 28). In a preferred embodiment, a first side bet at area 30 is a fixed amount wager (such as $1) that only wins on a Straight Flush for the five-card version. The payout is preferably a fixed amount, such as $50,000 for a fixed $1 wager. A second side bet at area 32 is a fixed payoff on a spread of hands with a variable wager amount. For example, with the five-card version, the payoff could be for a pat hand, meaning a Straight or better, and could be as high as 125 to 1. Since the two side bets at areas 30 and 32 are of a different nature, the bets could be played simultaneously. Naturally, the same principles could apply to three- and seven-card versions as shown. Preferably, participation in the base game including a compulsory bet at wager area 16 and/or wager area 18 is a prerequisite to enable participation in the side bet wagers 30, 32.

As would be apparent to those skilled in the relevant art, the invention can be embodied in a wide variety and forms of media such as, but not limited to, single player slot video machines, multi-player slot vide machines, electronic games and devices, lottery terminals, scratch-card formats, software, as well as in-flight, home and Internet entertainment. In addition, the invention can be readily implemented as a computer program product (e.g., floppy disk, compact disc, etc.) comprising a computer readable medium having control logic recorded therein to implement the features of the invention as described. Control logic can be loaded into the memory of a computer and executed by a central processing unit (CPU) to perform the operations described herein.

Figure 2:
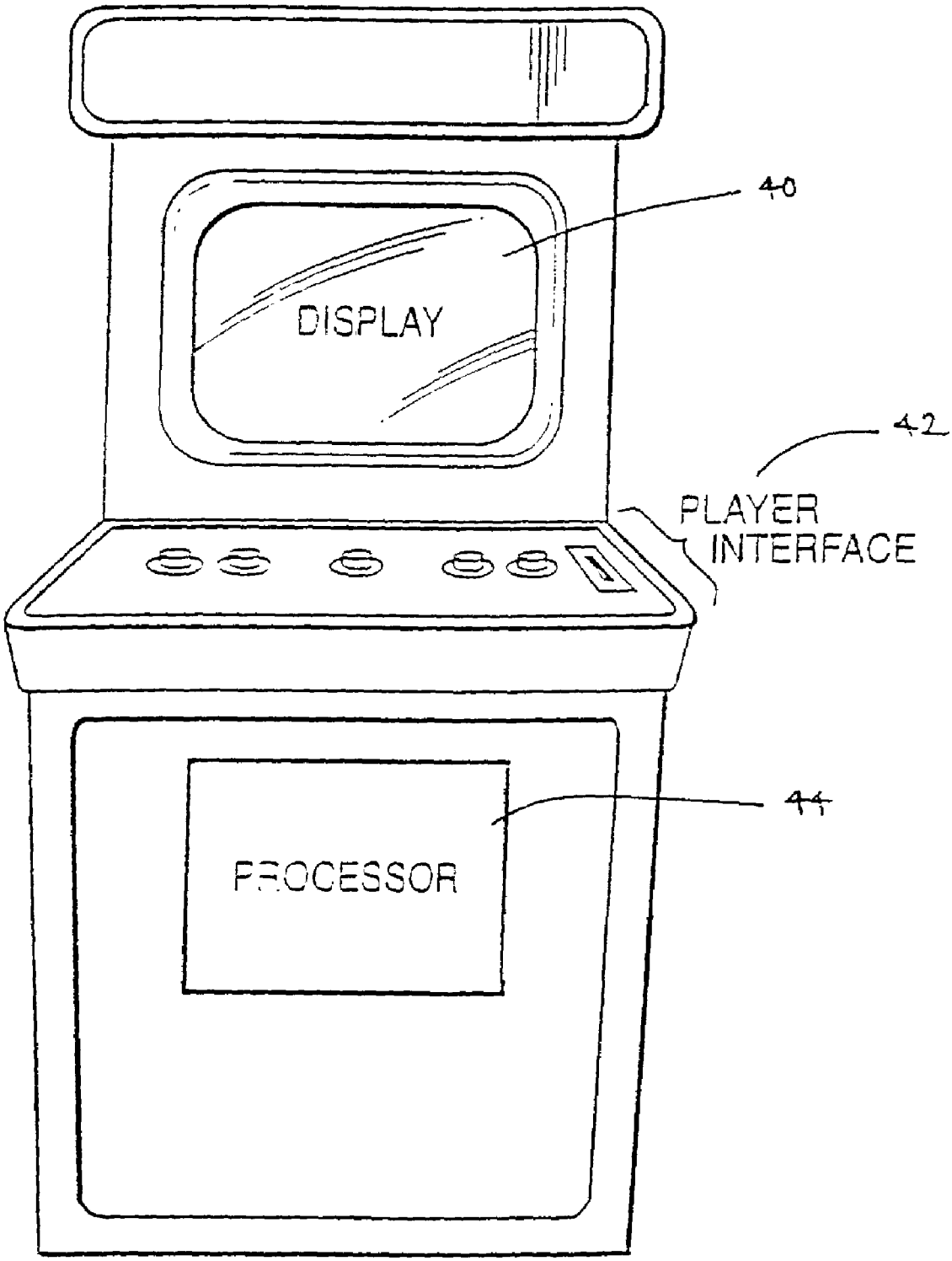
FIG. 2 is a block diagram illustrating the structure effecting game play according to the apparatus of the present invention.

In this context, referring to FIG. 2, a block diagram is illustrated showing the components of an apparatus configured for playing the game according to the invention. The apparatus includes a display 40, a player interface 42, and circuitry 44 for effecting game play and including structure for receiving wagers in one or more playing modes and dealing hands according to the rules of the game. The processing circuit 44 effects game play according to game rules and resolves wagers based on a comparison of player hand to the payout scale, player hand to dealer hand, and player hand to player hand, respectively.

With the game according to the present invention, three or four play methodologies utilizing a poker game desirably enables certain of the methodologies to be played without a house advantage. A plurality of options enable the players to play "customized" versions of the game against a payout scale, a payout scale and the dealer, the dealer only, and/or other players. The game also provides one or more side wager options that enhance player interest by providing a chance for a high payout.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A method of playing a casino game, comprising:

(a) receiving first and second wagers for at least a first playing mode, at least one of the first and second wagers in the first playing mode being compulsory;

(b) receiving at least a third wager for at least a second playing mode, wherein the second playing mode is without a house advantage;

(c) dealing hands of playing cards to a dealer and to at least one player;

(d) resolving the first and second wagers according to (1) a poker rank of the player hand against a first payout scale, and (2) the poker rank of the player hand against a second payout scale and the poker rank of the player hand against a poker rank of the dealer hand, respectively; and (e) resolving the third wager without a house advantage according to the poker rank of the player hand against at least one of (1) the poker rank of the dealer hand, and (2) a poker rank of another player hand.

2. A method according to claim 1, wherein step (b) is practiced by limiting an amount of the third wager based on the first and second wagers.

3. A method according to claim 2, wherein step (b) is practiced by limiting the amount of the third wager to a sum of the first and second wagers.

4. A method according to claim 1, wherein only one of the first and second wagers is compulsory.

5. A method according to claim 1, wherein both of the first and second wagers are compulsory.

6. A method according to claim 1, wherein the step of resolving one of the first and second wagers is practiced by paying a payout according to the player hand poker rank against a payout scale only if the player hand is better than the dealer hand.

7. A method according to claim 6, wherein the resolving step is further practiced by pushing the one of the first and second wagers if the player hand is tied with the dealer hand or if the player hand is inferior to the dealer hand.

8. A method according to claim 6, wherein the resolving step is further practiced by pushing the one of the first and second wagers if the player hand is tied with the dealer hand, and taking the one of the first and second wagers if the player hand is inferior to the dealer hand.

9. A method of playing a casino game, comprising:

(a) receiving first and second wagers for at least a first playing mode, at least one of the first and second wagers in the first playing mode being compulsory;

(b) receiving at least a third wager for at least a second playing mode, wherein the second playing mode is without a house advantage;

(c) dealing hands of playing cards to a dealer and to at least one player;

(d) resolving the first and second wagers according to (1) a poker rank of the player hand against a first payout scale, and (2) the poker rank of the player hand against a second payout scale and the poker rank of the player hand against a poker rank of the dealer hand, respectively; and (e) resolving the third wager without a house advantage according to the poker rank of the player hand against the poker rank of the dealer hand.

10. An apparatus for playing a casino game, comprising:

means for receiving first and second wagers for at least a first playing mode, at least one of the first and second wagers in the first playing mode being compulsory;

means for receiving at least a third wager for at least a second playing mode, wherein the second playing mode is without a house advantage;

means for dealing hands of playing cards to a dealer and to at least one player;

means for resolving the first and second wagers according to (1) a poker rank of the player hand against a first payout scale, and (2) the poker rank of the player hand against a second payout scale and the poker rank of the player hand against a poker rank of the dealer hand, respectively; and means for resolving the third wager without a house advantage according to the poker rank of the player hand against at least one of (1) the poker rank of the dealer hand, and (2) a poker rank of another player hand.

* * * * *